United States Patent [19]

Steiner

[11] Patent Number: 4,531,553

[45] Date of Patent: Jul. 30, 1985

[54] MULTIPLE LONGITUDINAL TRAVERSING SHED WEAVING MACHINE CONTAINING A WEAVING ROTOR

[75] Inventor: Alois Steiner, Rieden, Switzerland

[73] Assignee: Sulzer-Rüti Machinery Works Ltd., Rüti, Switzerland

[21] Appl. No.: 555,592

[22] Filed: Nov. 28, 1983

[30] Foreign Application Priority Data

Dec. 10, 1982 [CH] Switzerland ..... 7205/82

[51] Int. Cl.[3] ..... D03D 41/00

[52] U.S. Cl. ..... 139/28

[58] Field of Search ..... 139/11, 28

[56] References Cited

U.S. PATENT DOCUMENTS 4,291,729 9/1981 Steiner ..... 139/28

FOREIGN PATENT DOCUMENTS 2072719 10/1981 United Kingdom ..... 139/11 A 186898 3/1970 U.S.S.R. ..... 139/28

*Primary Examiner*—Henry S. Jaudon

*Attorney, Agent, or Firm*—Werner W. Kleeman

[57] ABSTRACT

At the weaving rotor there are alternatingly arranged with respect to the direction of rotation thereof first lamellae combs formed by beat-up lamellae for the weft threads and second lamellae combs formed by guide lamellae for the warp threads and including shed-retaining elements for the upper shed position of the wrap threads. The shed-retaining elements for the lower shed position are arranged within each pair of lamellae combs formed by a first lamellae comb and a second lamellae comb at the intersection point of the two groups of warp threads which assume the upper and the lower shed positions, respectively, and are formed by an element extending essentially parallel to the lamellae combs. In the lower shed the warp threads are thus always located in a common plane and the elements forming the shed-retaining elements for the lower shed position can be installed and disassembled without interference with the lamellae combs.

8 Claims, 2 Drawing Figures

MULTIPLE LONGITUDINAL TRAVERSING SHED WEAVING MACHINE CONTAINING A WEAVING ROTOR

CROSS-REFERENCES TO RELATED APPLICATIONS

This application is related to (i) the commonly assigned, copending U.S. application Ser. No. 06/483,526, now U.S. Pat. No. 4,487,233, filed Apr. 11, 1983, entitled "MULTIPLE LONGITUDINAL TRAVERSING SHED WEAVING APPARATUS"; (ii) the commonly assigned, copending U.S. application Ser. No. 06/483,527, now U.S. Pat. No. 4,512,374, filed Apr. 11, 1983, entitled "LAMELLAE COMB FOR WEAVING APPARATUS, PARTICULARLY FOR A WEAVING ROTOR IN A MULTIPLE LONGITUDINAL TRAVERSING SHED WEAVING LOOM AND METHOD FOR MANUFACTURING THE SAME"; and (iii) the commonly assigned, copending U.S. application Ser. No. 06/555,622, now U.S. Pat. No. 4,498,501, filed Nov. 28, 1983, entitled "MULTIPLE LONGITUDINAL TRAVERSING SHED WEAVING MACHINE CONTAINING A WEAVING ROTOR".

BACKGROUND OF THE INVENTION

The present invention relates to a new and improved multiple longitudinal traversing shed weaving machine or loom containing a weaving rotor.

In its more particular aspects the present invention relates to a new and improved multiple longitudinal traversing shed weaving machine containing a weaving rotor at which first lamellae combs formed by beat-up lamellae for the weft threads and second lamellae combs formed by guide lamellae for the warp threads and including shed-retaining elements for the upper shed position of the warp threads are alternatingly arranged in the direction of rotation of the weaving rotor. With this arrangement control means are arranged in front of the weaving rotor in respect of the running or travel direction of the warp threads in order to laterally deflect and selectively allocate each warp thread to a shed-retaining element.

In a multiple longitudinal traversing shed weaving machine of this type as known, for example, from U.S. Pat. No. 4,290,458, granted Sept. 22, 1981, the shed-retaining elements for the lower shed position are also arranged within the second lamellae combs. As a consequence, a warp thread which assumes the lower shed position in a number of successive lamellae combs will run or extend differently from the remaining warp threads in the group. This will result in undesired differences in the tension of individual warp threads.

Furthermore, the shed-retaining elements for the lower shed position in the known multiple longitudinal traversing shed weaving machine are formed by elements which are arranged sequentially or in a row between the lamellae of the second lamellae combs. Considering that, for example, in a 1-1 weave the warp threads are always tensioned between the shed-retaining elements for the upper shed position, and thus, automatically arrive at the lower shed position, no shed-retaining elements are required for the lower shed position. It will thus be recognized that for this specific but frequently occurring weave the relatively expensive shed-retaining elements could be omitted. In such a case, however, the same have to be replaced by fitting spacer elements and, additionally, the second lamellae combs have to be disassembled and converted or exchanged in the event of a weave change requiring the use of shed-retaining elements for the lower shed position.

SUMMARY OF THE INVENTION

Therefore, with the foregoing in mind it is a primary object of the present invention to provide an improved construction of a multiple longitudinal traversing shed weaving machine containing a weaving rotor in which all the warp threads in the lower shed are positioned in a common plane for all kinds of weaves.

Another important object of the present invention aims at the provision of a new and improved construction of a multiple longitudinal traversing shed weaving machine containing a weaving rotor in which, in the case of a weave requiring the use of shed-retaining elements for the lower shed position, no disassembly due to such shed-retaining elements is required for the relevant lamellae combs.

Now in order to implement these and still further objects of the invention, which will become more readily apparent as the description proceeds, the weaving machine or loom of the present development is manifested by the features that, the shed-retaining elements for the lower shed position are arranged within each pair of lamellae combs formed by a first and a second lamellae comb, at the intersection point of the two groups of warp threads assuming the upper and the lower shed position, and each of the shed-retaining elements is formed by an element arranged essentially parallel to the lamellae combs.

By virtue of such an arrangement of the shed-retaining elements for the lower shed position at the aforementioned intersection point all the warp threads in the lower shed are positioned in a common plane for all weaves. This is so because the shed-retaining elements are arranged at a location which the warp threads automatically assume because they are tensioned between the shed-retaining elements for the upper shed position. By forming each of the aforementioned shed-retaining elements by an element extending substantially parallel to the lamellae combs, the shed-retaining elements can be disassembled without interference with the lamellae combs. On the other hand, the shed-retaining elements are simple in design and inexpensive to manufacture. They are in fact so ineffensive that they practically do not affect the costs of the lamellae combs. There is therefore no economic need of omitting them nor any incentive to do so. They can thus remain in place and need not be replaced by fitting spacer elements and, additionally, the second lamellae combs do not have to be disassembled or converted or exchanged in the event of a weave change requiring the use of shed-retaining elements for the lower shed position, not even for the production of 1-1 weaves.

BRIEF DESCRIPTION OF THE DRAWINGS:

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
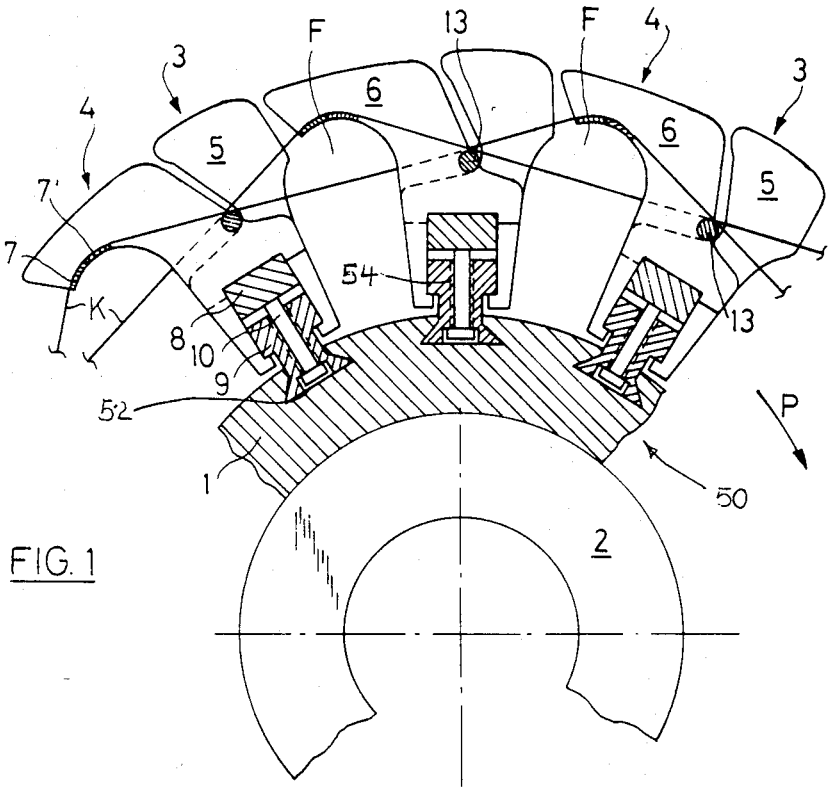
FIG. 1 is a fragmentary cross-sectional view through a weaving rotor of a weaving machine or loom constructed according to the present invention.

Describing now the drawings, it is to be understood that only enough of the construction of the weaving machine or loom has been shown as needed for those skilled in the art to readily understand the underlying principles and concepts of the present development, while simplifying the showing of the drawings. Turning attention now specifically to FIG. 1, there has been illustrated in cross-section therein a weaving rotor 50 of a multiple longitudinal traversing shed weaving machine. The weaving rotor 50 comprises a hollow shaft 1 which extends across the width of the weaving machine. At its end faces this hollow shaft 1 is supported by tube stubs or journals 2 which are mounted at the standard frame (not shown) of the weaving machine. During operation the weaving rotor 50 rotates in the direction indicated by arrow P in FIG. 1. The construction and operation of a multiple longitudinal traversing shed weaving machine or loom containing a weaving rotor is assumed to be well known to those skilled in the art and, therefore, is not here explained in any great detail; reference is, however, made in this regard to the aforementioned U.S. Pat. No. 4,290,458.

At the jacket or outer surface of the hollow shaft 1 there are arranged first and second lamellae combs 3 and 4 which extend essentially parallel to the longitudinal axis of the hollow shaft 1. The first lamellae combs 3 include beat-up lamellae 5 for beating-up the inserted weft or filling threads. The second lamellae combs 4 include guide lamellae 6 for the warp threads K. The guide lamellae 6 are provided with shed-retaining elements 7, 7' for the upper shed position of the warp threads K. These shed-retaining elements for the upper shed position of the warp threads K are formed by projections 7, 7' which laterally protrude from the guide lamellae 6. Each guide lamella 6 is provided either with a projection 7 or with a projection 7' which protrude to different sides of the guide lamellae 6 and which are offset from each other in the warp direction. In each second lamellae comb 4 each so-called tube, i.e. each intermediate space between adjacent guide lamellae 6, is alternatingly intended for the upper shed position and lower shed position of the warp threads K. In each tube intended for the upper shed position the related shed-retaining element is formed by two projections 7, 7' which protrude towards each other. Due to the offset arrangement of such projections 7, 7' in the warp direction the tube width can be adjusted between once and twice the value of the laterally protruding dimension of the projections 7, 7'.

In the direction of rotation P of the weaving rotor 50 there is provided between each second and first lamellae comb 4 and 3 at the location of the maximum shed opening a guide passage or channel F which is upwardly defined or bounded by the projections 7, 7'. The weft insertion occurs in the guide passage or channel F. Since in a multiple longitudinal traversing shed weaving machine containing the depicted weaving rotor, in principle, any known weft insertion method or system employing, for example, gripper shuttles, projectiles, rapier grippers or air can be used and since the weaving rotor as shown is not limited in use to and is not specific to any particular weft insertion method, the weft insertion method is not here explained in any great detail, particularly since the details thereof are unimportant in terms of the subject matter of the present invention. Reference is however made to U.S. patent application, Ser. No. 06/463,022, filed Feb. 1, 1983, now U.S. Pat. No. 4,484,603, relating particularly to a suitable type of weft insertion system using air, to which reference may be readily had and the disclosure of which is incorporated herein by reference.

The beat-up lamellae 5 of the first lamellae combs 3, on the one hand, and the guide lamellae 6 of the second lamellae combs 4, on the other hand, are aligned with each other and the lines of alignment of the individual guide lamellae 6 extend at the center of the tube defined by the beat-up lamellae 5 and vice-versa. The beat-up lamellae 5 of the first lamellae combs 3 thus are arranged along first circumferential circles and the guide lamellae 6 of the second lamellae combs 4 are arranged along second circumferential circles at the hollow shaft 1 and the two kinds of circumferential circles are offset from each other by half a pitch, i.e. by half a tube width. At its outer surface or jacket the hollow shaft 1 is provided with dove-tail grooves 52 extending substantially parallel to the shaft axis and corresponding in number to the number of guide passages or channels F. Each dove-tail groove 52 is intended to accommodate one carrier or support for each one of said first and said second lamellae combs 3, 4.

Figure 2:
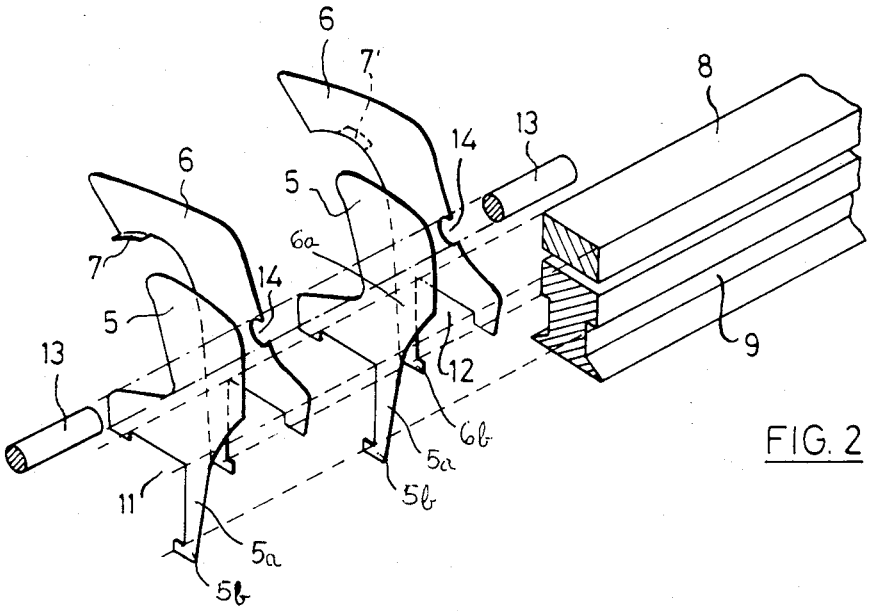
FIG. 2 is a schematic illustration in a perspective and exploded view of some of the lamellae including their carrier or support in the weaving rotor shown in FIG. 1.

According to the illustration in FIGS. 1 and 2 of the drawings, the carrier or support comprises two mutually parallel rails or rail members 8 and 9, the rail 9 being provided with a dove-tail corresponding to the aforementioned dove-tail groove 52. Each rail 9 is also provided with threaded bores 54 which are spaced along its length at a distance of about 5 to 10 cm. A countersunk screw or bolt 10 is threaded from below into each one of the threaded bores 54. These screws or bolts 10 protrude from the rail 9 with one end thereof and press against the other related rail 8. By rotating the threaded screws or bolts 10 the distance between the two rails 8 and 9 can be adjusted.

Each lamella 5 and 6 comprises a mounting leg or limb **5*a* and 6*a*, respectively which surrounds a jaw or mouth 11 and 12, respectively, which partially extends around the rails 8, 9. The jaw or mouth 11 and 12 at each beat-up lamella 5 and at each guide lamella 6, respectively, is defined or bounded at the end of each mounting leg or limb 5*a* and 6*a* by a respective protrusion 5*b* and 6*b*. The protrusions or projections 5*b* and 6*b* are intended to snap about or engage with one edge of two diagonally opposed edges of the two rails 8 and 9. The width of each jaw or mouth 11 and 12 and the cross-section of the rails 8, 9 are dimensioned such that, when the threaded screws or bolts 10 are loosened, i.e. when the two rails 8 and 9 are slightly spaced from each other, the beat-up lamella 5 and the guide lamella 6 can be pushed over the rails 8 and 9 with their respective mounting legs or limbs 5*a* and 6*a* and can be subsequently fixed by readjusting such threaded screws or bolts 10**.

Each carrier or support formed by the rails 8 and 9 carries two lamellae combs which are offset from each other by half a pitch or division or tube width, namely a first lamellae comb 3 including beat-up lamellae 5 and a second lamellae comb 4 including guide lamellae 6. Each carrier or support is fixed in a related one of the dove-tail groove or channel 52.

As will be evident from FIG. 1, the geometry of the lamellae combs 3 and 4 at the weaving rotor 50 is designed such that at any time when a warp thread K in the guide passages F alternatingly assumes the upper or lower shed position, and thus, is always tensioned between the projections 7, 7' of a particular second lamellae comb 4 and the second next or second following second lamellae comb 4, the intersection point of the groups of warp threads is always located in the intermediate space formed between the first and second lamellae combs 3 and 4 of a lamellae comb pair supported at a common carrier or support. At large warp densities, i.e. with small spaces between the lamellae in the weft direction, such structure facilitates the shed changing movement of the warp threads K.

When the warp threads K wrap around the weaving rotor 50 in this manner and when additionally, as seen in the weft direction, the warp threads K always alternatingly assume the upper or lower shed position within each second lamellae comb 4, such arrangement corresponds to a 1/1 weave or linen weave. In this case the warp threads K automatically assume the lower or bottom shed position in each second guide passage F since they are tensioned between the projections 7, 7' of the different second lamellae combs 4. For this type of weave there would thus not be required any special shed-retaining elements for the lower shed position.

In case of other weaves, i.e. in all those cases in which the warp threads K assume the lower shed position at lamellae comb pairs which follow each other in the direction of rotation P of the weaving rotor 50, shed-retaining elements are required for the lower or bottom shed position. As illustrated, such shed-retaining elements are formed by an elongate element 13 which forms a rod or tube and which extends essentially parallel to the lamellae combs 3 and 4. The element 13 is mounted at the location of the intersection point of the groups of warp threads K at each pair of lamellae combs 3 and 4. As illustrated, the guide lamellae 6, 6' are each provided with a recess or groove 14 to hold the shed-retaining element 13 which preferably extends in one-piece over the entire length of the lamellae combs 3 and 4.

The invention is not limited to the illustrated arrangement of each two lamellae combs 3 and 4 being mounted on a common carrier or support. It will be self-evident that also each one of the lamellae combs 3 or 4 can be individually arranged as such at the hollow shaft 1 in any suitable manner. Equally the shed-retaining element 13 shown in FIG. 2 can have any desired shape within wide limits. It is essential that this shed-retaining element 13 be arranged at the intersection point of the groups of warp threads K. The position of such intersection point may also vary and depends on the selected geometry. The intersection point could also be located within the first and second lamellae combs 3, 4. In such case the respective beat-up or guide lamellae 5 or 6 would contain an appropriate bore through which the shed-retaining element 13 would be pushed and piercingly extend.

Since the shed-retaining element 13 extends over the entire length of the lamellae combs 3, 4 the same also and automatically always extends across the entire width of each tube provided for the lower shed position of the warp threads and, in particular, independently of the width of such tubes. This means that on changes in the warp density, and thus, the pitch of the lamellae no changes or conversions are required which are due to the shed-retaining elements for the lower shed position.

While there are shown and described present preferred embodiments of the invention, it is to be distinctly understood that the invention is not limited thereto, but may be otherwise variously embodied and practiced within the scope of the following claims.

What I claim is:

1. A multiple longitudinal traversing shed weaving machine, comprising:

a weaving rotor rotatable in a predetermined direction of rotation;

first and second lamellae combs alternatingly arranged at said weaving rotor in said direction of rotation;

each said first lamellae comb comprising beat-up lamellae for weft threads;

each said second lamellae comb comprising guide lamellae for warp threads and containing shed-retaining elements defining an upper shed position of said warp threads;

groups of warp threads assuming an upper shed position and a lower shed position, respectively, and defining intersection points;

shed-retaining elements defining a lower shed position of said warp threads; and each said shed-retaining element defining said lower shed position being arranged at one of said intersection points within each pair of lamellae combs formed by one of said first and one of said second lamellae combs and being formed by an element extending substantially parallel to said first and second lamellae combs.

2. The weaving machine as defined in claim 1, wherein:

said shed retaining element for the lower shed position is formed in one-piece and extends essentially over the entire length of said first and second lamellae combs.

3. The weaving machine as defined in claim 2, wherein:

said shed retaining element for the lower shed position comprises a rod.

4. The weaving machine as defined in claim 2, wherein:

said shed retaining element for the lower shed position comprises a tube.

5. The multiple longitudinal traversing shed weaving machine as defined in claim 1, wherein:

said weaving rotor comprises a plurality of mutually parallel rail members extending longitudinally of said weaving rotor; and said first and second lamellae combs being conjointly supported in pairs upon said rail members.

6. A multiple longitudinal traversing shed weaving machine, comprising:

a weaving rotor rotatable in a predetermined direction of rotation;

first and second lamellae combs alternatingly arranged at said weaving rotor in said direction of rotation; each said first lamellae comb comprising beat-up lamellae for weft threads;

each said second lamellae comb comprising guide lamellae for warp threads and containing shed-retaining elements defining an upper shed position of said warp threads;

groups of warp threads assuming an upper shed position and a lower shed position, respectively, and defining intersection points;

shed-retaining elements defining a lower shed position of said warp threads;

each said shed-retaining element defining said lower shed position being arranged at one of said intersection points within each pair of lamellae combs formed by one of said first and one of said second lamellae combs and being formed by an element extending substantially parallel to said first and second lamellae combs;

guide means provided at said lamellae of said second lamellae combs;

said first and second lamellae combs defining a shed geometry such that said intersection point defined by said groups of warp threads is located in an intermediate space formed between one of said first and one of said second lamellae combs following each other in said predetermined direction of rotation of said weaving rotor; and said shed-retaining element defining said lower shed position being retained in said guide means.

7. A multiple longitudinal traversing shed weaving machine, comprising:

a weaving rotor rotatable in a predetermined direction of rotation;

first and second lamellae combs alternatingly arranged at said weaving rotor in said direction of rotation;

each said first lamellae comb comprising beat-up lamellae for weft threads;

each said second lamellae comb comprising guide lamellae for warp threads and containing shed-retaining elements defining an upper shed position of said warp threads;

groups of warp threads assuming an upper shed position and a lower shed position, respectively, and defining intersection points;

shed-retaining elements defining a lower shed position of said warp threads;

each said shed-retaining element defining said lower shed position being arranged at one of said intersection points within each pair of lamellae combs formed by one of said first and one of said second lamellae combs and being formed by an element extending substantially parallel to said first and second lamellae combs;

recesses formed at said lamellae of said first lamellae combs;

said first and second lamellae combs defining a shed geometry such that said intersection point defined by said groups of warp threads is located within each said first lamellae comb; and said shed-retaining element defining said lower shed position being retained in said recesses.

8. A multiple longitudinal traversing shed weaving machine, comprising:

a weaving rotor rotatable in a predetermined direction of rotation;

first and second lamellae combs alternatingly arranged at said weaving rotor in said direction of rotation; each said first lamellae comb comprising beat-up lamellae for weft threads;

each said second lamellae comb comprising guide lamellae for warp threads and containing shed-retaining elements defining an upper shed position of said warp threads;

groups of warp threads assuming an upper shed position and a lower shed position, respectively, and defining inersection points;

shed-retaining elements defining a lower shed position of said warp threads;

each said shed-retaining element defining said lower shed position being arranged at one of said intersection points within each pair of lamellae combs formed by one of said first and one of said second lamellae combs and being formed by an element extending substantially parallel to said first and second lamellae combs;

guide means provided for said lamellae of one of said lamellae combs;

said first and second lamellae combs defining a shed geometry such that said intersection point defined by said groups of warp threads is located in an intermediate space formed between one of said first and one of said second lamellae combs following each other in said predetermined direction of rotation of said weaving rotor; and said shed-retaining element defining said lower shed position being retained in said guide means.

* * * * *